US008424730B2

(12) United States Patent
Brunning

(10) Patent No.: US 8,424,730 B2
(45) Date of Patent: Apr. 23, 2013

(54) PACK WITH INTEGRATED SEAT

(76) Inventor: Joseph Brunning, New Paltz, NY (US)

( * ) Notice: Subject to any disclaimer, the term of this patent is extended or adjusted under 35 U.S.C. 154(b) by 512 days.

(21) Appl. No.: 12/709,026

(22) Filed: Feb. 19, 2010

(65) Prior Publication Data

US 2011/0204106 A1 Aug. 25, 2011

(51) Int. Cl.
*A45F 4/02* (2006.01)

(52) U.S. Cl.
USPC ..... 224/155; 224/633; 224/634

(58) Field of Classification Search ..... 224/155, 224/153, 576, 577, 633, 634; 297/4, 17, 297/129
See application file for complete search history.

(56) References Cited

U.S. PATENT DOCUMENTS

| | | | | |
|---|---|---|---|---|
| 168,402 | A | 10/1875 | Laumonier | |
| D295,580 | S | 5/1988 | Thomas | |
| 4,773,574 | A * | 9/1988 | Burgard | 224/155 |
| 5,289,958 | A * | 3/1994 | Jay | 224/155 |
| 5,375,905 | A * | 12/1994 | Flitter et al. | 297/15 |
| 5,445,301 | A | 8/1995 | Biedenharn | |
| 5,462,213 | A | 10/1995 | Watt | |
| 5,562,236 | A * | 10/1996 | Monzingo | 224/153 |
| 5,597,101 | A | 1/1997 | Barber | |
| 6,079,599 | A | 6/2000 | Nordstrom | |
| 6,161,739 | A | 12/2000 | Bentzen | |
| 6,217,113 | B1 | 4/2001 | Knatz | |
| 6,547,110 | B2 | 4/2003 | O'Hare | |
| 6,651,853 | B2 | 11/2003 | Higgins | |
| 7,052,080 | B2 * | 5/2006 | Knight et al. | 297/4 |
| 7,350,857 | B2 | 4/2008 | Bishop | |
| 2002/0000740 | A1 * | 1/2002 | Laughlin et al. | 297/36 |
| 2007/0205234 | A1 | 9/2007 | Lessman | |
| 2008/0061093 | A1 | 3/2008 | Pottharst | |
| 2008/0149676 | A1 | 6/2008 | Bartel | |
| 2008/0179358 | A1 | 7/2008 | Redzisz et al. | |

* cited by examiner

*Primary Examiner* — Justin Larson
*Assistant Examiner* — Adam Waggenspack
(74) *Attorney, Agent, or Firm* — Simpson & Simpson, PLLC

(57) ABSTRACT

A pack with an integrated seat, including a base member comprising oppositely disposed first and second edges, a fixed leg member connected to the first edge, a hinged leg member pivotally connected to the second edge, a rigid seat member pivotally connected to the fixed leg member and arranged to be supported by the fixed leg member and the hinged leg member when the pack is arranged in a seating position, a shell arranged to at least partially enclose a volume defined by the fixed leg member, the hinged leg member, and the base member.

17 Claims, 9 Drawing Sheets

PACK WITH INTEGRATED SEAT

FIELD OF THE INVENTION

The invention broadly relates to packs, particularly to packs with frames, and even more particularly to a pack with a frame for supporting an integrated seat.

BACKGROUND OF THE INVENTION

Backpacks, book bags, knapsacks, and the like are well known in the art. These packs are commonly carried on the back and are favored for their ability to transport large loads without hindering the user's freedom of movement. Packs that are constructed entirely out of pliable materials are light-weight and capable of carrying a variety of objects. Some packs also provide additional support for the wearer of the pack, whether through the use of rigid materials or a discrete frame. These types of packs distribute heavy loads better and offer additional protection to the objects within the pack.

Users performing strenuous activities, such as hiking, may carry their belongings in a pack having a frame. Adding a seat to such a pack would provide these users with a place to rest without having to carry a completely separate piece of equipment. However, the addition of a seat must not compromise the usefulness of the pack. Furthermore, many packs do not have frames, and integrating a seat into a pack requires a frame or other means of sufficient strength to support a human. Moreover, the frame must be light enough to be easily carried, or else it makes the pack too cumbersome to use on a day to day basis. For example, current packs having fixed dimensions may prevent the pack from fitting into places where packs are commonly stowed, such as in overhead compartments on trains or airplanes, as well as between seats on buses or in classrooms, theatres, stadiums, arenas, or the like. In other words, it is not convenient to carry a fixed frame hiking backpack onto a bus or plane. Thus, it is desirable for the frame of a pack to be collapsible, so that it can be used on a regular basis for day to day activities, not just hiking.

A further obstacle is the manner in which the load on the seat is distributed to the frame. If the support members are not axially aligned with the load, then the load will result in moments which tend to bend the support members of the frame. For example, a flexible seat will distribute the load both vertically and laterally on the support members of the frame. It is desirable to minimize the non-axial portions of the load exerted on the frame to reduce moments which cause the frame to bend and warp.

Scissor style frames are known to create collapsible frames, but are subject to large non-axial forces and moments corresponding to these forces. Moreover, the entire load is hinged about one single point at the middle of the frame, so all of the support members are subjected to bending about that point.

Thus, there is a long-felt need for a pack that also functions as a seat, has a light-weight frame which is also capable of collapsing to a smaller volume, has a seat that does not interfere with access to the interior of the pack, and is arranged to distribute the load from the seat efficiently across the frame.

BRIEF SUMMARY OF THE INVENTION

The present invention broadly comprises a pack with an integrated seat, including a base member comprising oppositely disposed first and second edges, a fixed leg member connected to the first edge, a hinged leg member pivotally connected to the second edge, a rigid seat member pivotally connected to the fixed leg member and arranged to be supported by the fixed leg member and the hinged leg member when the pack is arranged in a seating position, a shell arranged to at least partially enclose a volume defined by the fixed leg member, the hinged leg member, and the base member.

In one embodiment, the base member is a rigid material, a flexible material, or combinations thereof. In one embodiment, the fixed leg member comprises first and second fixed leg members. In one embodiment, the first and second fixed leg members are fixedly connected to each other by a cross-bar. In one embodiment, the hinged leg member comprises first and second hinged leg members. In a further embodiment, each of the first and second hinged leg members are pivotally connected to the base member by a butt hinge, a continuous hinge, a strap hinge, or combinations thereof. In a further embodiment, the first and second hinged leg members are fixedly connected to each other by the continuous hinge.

In one embodiment, the first and second hinged leg members are fixedly connected to each other. In one embodiment, the hinged leg member is arranged to pivot toward the fixed leg member, pivot away from the fixed leg member, or pivot toward and away from the fixed leg member. In one embodiment, the rigid seat member has at least one padded surface. In one embodiment, the shell comprises a flexible material, a rigid material, or combinations thereof. In one embodiment, at least one shoulder strap for enabling a user to carry the pack is connected to the shell, the fixed leg members, the hinged leg members, the base member, or combinations thereof.

In one embodiment, the fixed leg member is perpendicularly secured to the base member and the hinged leg member is perpendicularly oriented with respect to the base member when the pack is in the seating position. In one embodiment, the hinged leg member is at an angle greater than 90° with respect to the base member and directed away from the first edge when the pack is in the seating position. In one embodiment, the seat has a bore operatively arranged for engagement with the hinged leg member when the pack is in the seating position. In one embodiment, at least one cargo strap for providing additional storage space is connected to the shell, the fixed leg member, the hinged leg member, the base member or combinations thereof.

The current invention also broadly comprises an integrated seat, including a base member with oppositely disposed first and second edges, first and second fixed leg members connected to the first edge, first and second hinged leg members pivotally connected to the second edge, a rigid seat member pivotally connected to the first and second fixed leg members and arranged to be supported by the first and second fixed leg members and the first and second hinged leg members when in a seating position, a shell comprised of a flexible material, a rigid material, or combinations thereof, and arranged to at least partially enclose a volume defined by the fixed leg members, the hinged leg members, and the base member, and at least one strap connected to the shell, the fixed leg members, the hinged leg members, the base member, or combinations thereof.

It is a general object of the present invention to provide a pack that also functions as a seat for the user of the pack.

It is another general object of the present invention to provide a pack with a frame that can be partially collapsed for compact transport.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "pack" is synonymous with terms such as "backpack", "bag", "rucksack", "knapsack", etc., and such terms may be used interchangeably as appearing in the specification and claims. Although any methods, devices or materials similar or equivalent to those described herein can be used in the practice or testing of the invention, the preferred methods, devices, and materials are now described.

Figure 1A:
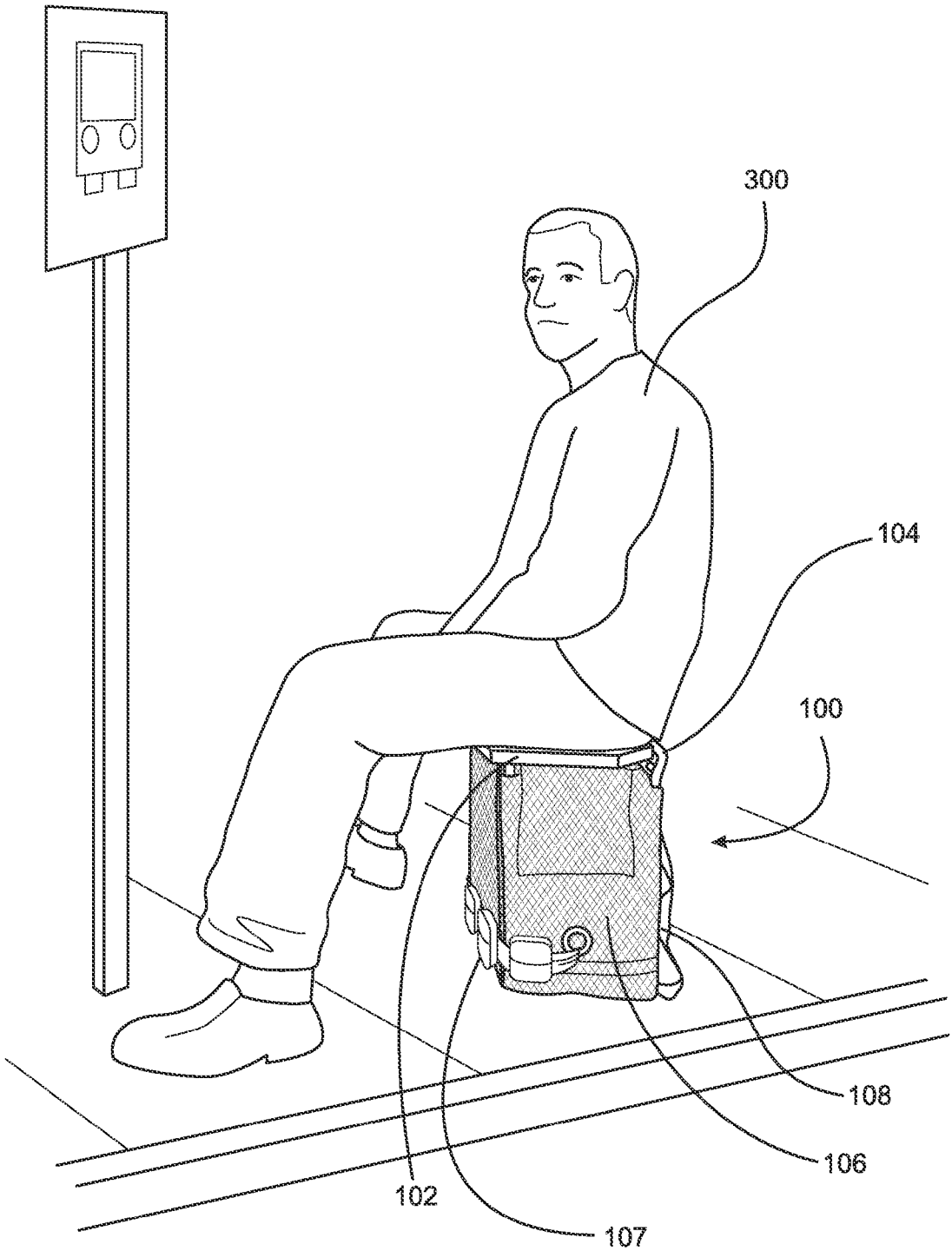
FIG. 1A is a perspective view of a user seated on a pack with an integrated seat according to the current invention.
Figure 1B:
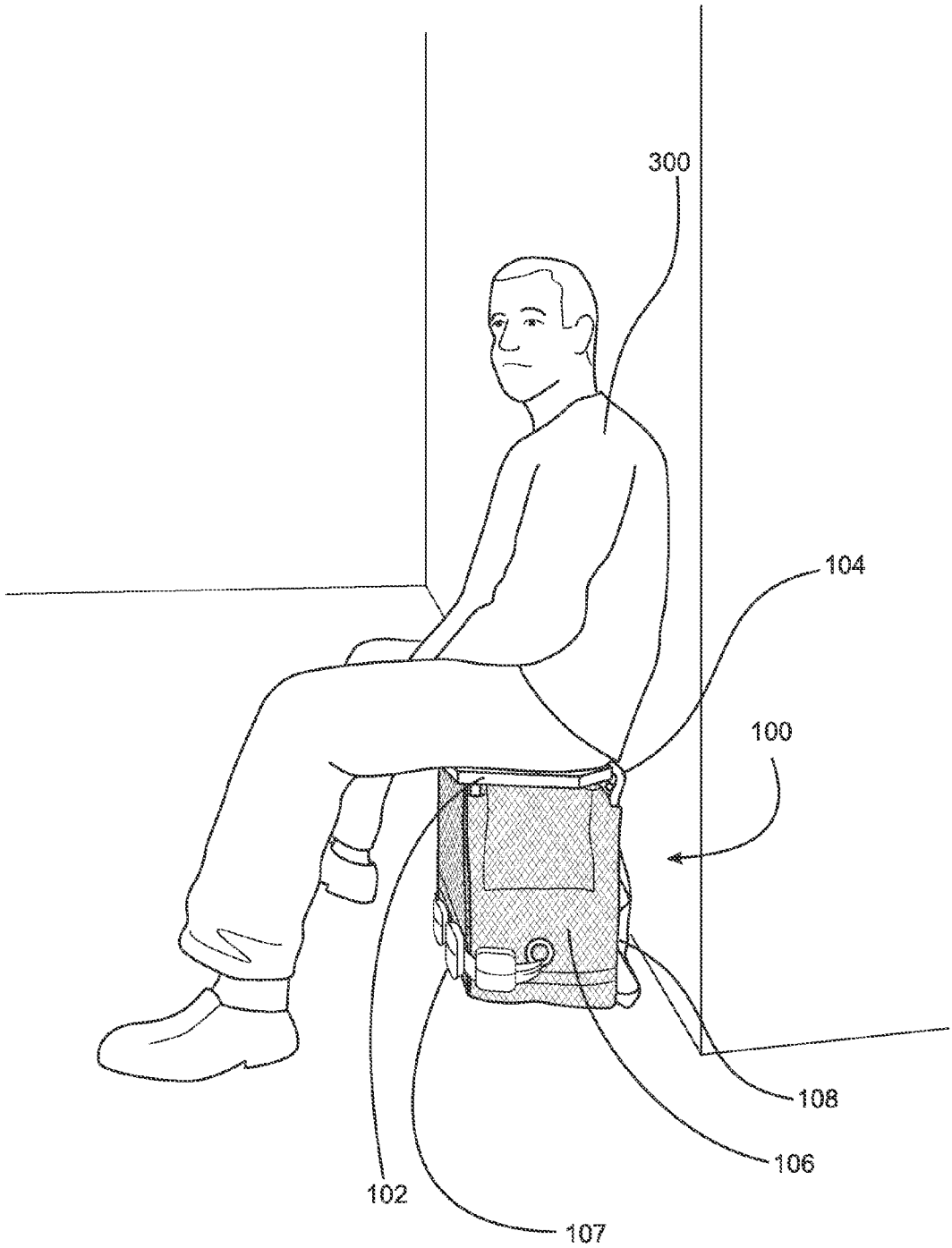
FIG. 1B is a perspective view of a user seated on a pack with an integrated seat according to the current invention.

Referring now to the figures, FIG. 1A shows person 300 seated on pack 100. Pack 100 includes integrated seat 102 which enables the person to sit on the pack without damaging the pack or the contents of the pack. As illustrated, a person may find pack 100 most advantageous when seating is desired but unavailable, such as when waiting for a bus at a street corner. As another example of the use of pack 100, FIG. 1B shows person 300 seated near a wall, such as a wall of a building, so that the user can also lean against the wall.

Frame 104 is included within shell 106 of the pack for supporting seat 102. In one embodiment, the shell may be partially or entirely internal to the frame. The frame is preferably manufactured from a strong, rigid material, such as steel. The pack may resemble an ordinary backpack, having straps 108 for enabling a user to carry the pack, such as about the user's shoulders, and shell 106 made of a flexible material, such as polyester fabric. Portions of the shell may be rigid, such as a durable rubberized bottom portion. Shell 106 of pack 100 defines at least one pocket or cavity therein, accessible by some selectably closeable means, such as a zipper, drawstring, snaps, buckles, hook and loop fastening material, or the like. To increase storage space, cargo strap 107 may also be included affixed about the exterior of the pack. The cargo strap includes at least one pocket or compartment, which may be selectably sealable by any means known in the art. The strap is pivotally connected to at least one side of the pack and detachably connected to at least the other side. In this way, the detachable end of the cargo strap can detach for orientation either behind the pack, or in front of the waist of a wearer of the pack. In such an embodiment, the strap is also preferably adjustable so it can be properly tightened depending on the arrangement of the strap and size of the user of the pack. One of ordinary skill in the art would recognize that pack 100 may include any number of pockets, zippers, snaps, buckles, compartments, and the like.

Figure 2:
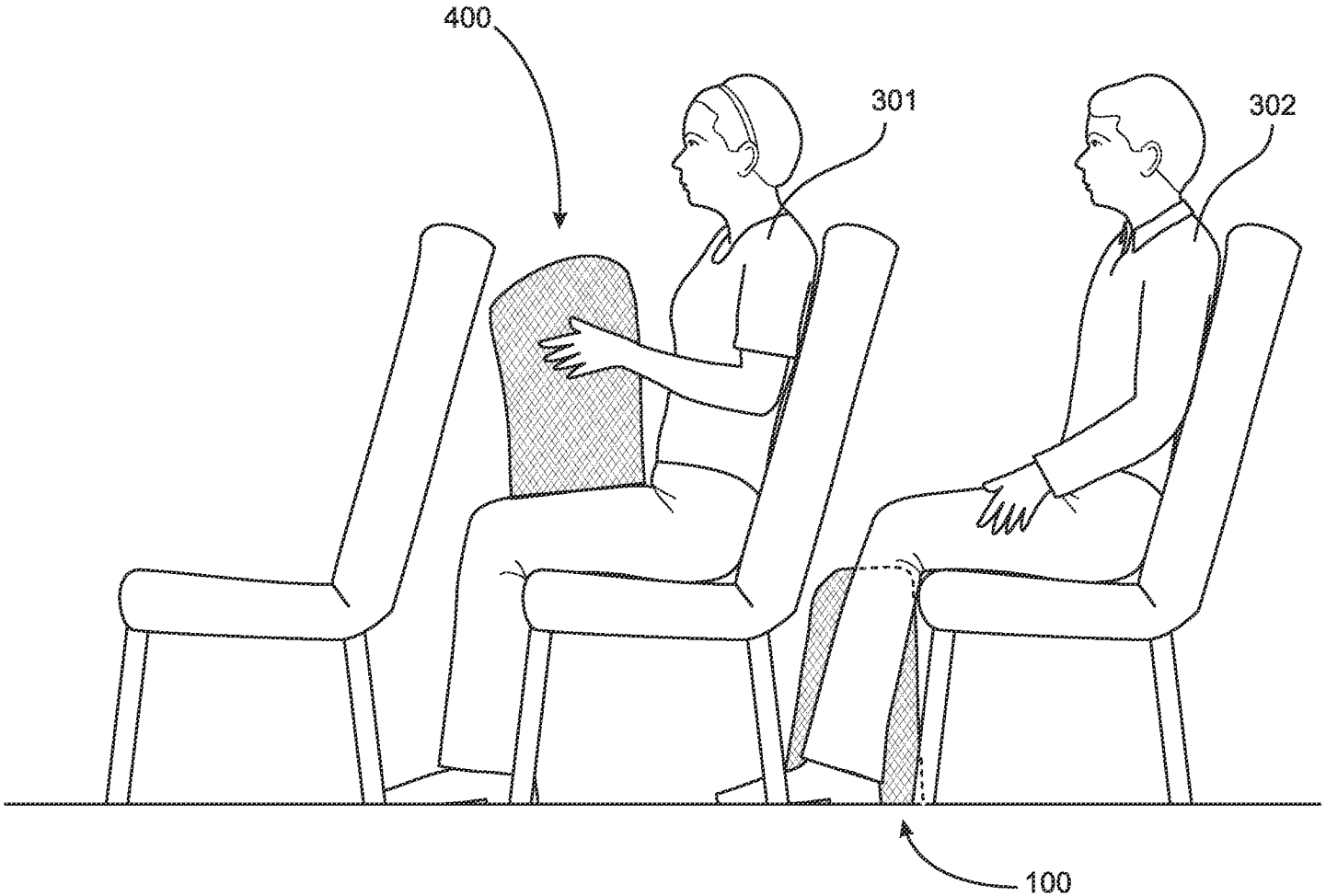
FIG. 2 is illustrates a user utilizing the collapsibility of the pack shown in FIG. 1 to stow the pack on the floor between two closely arranged seats.
Figure 3:
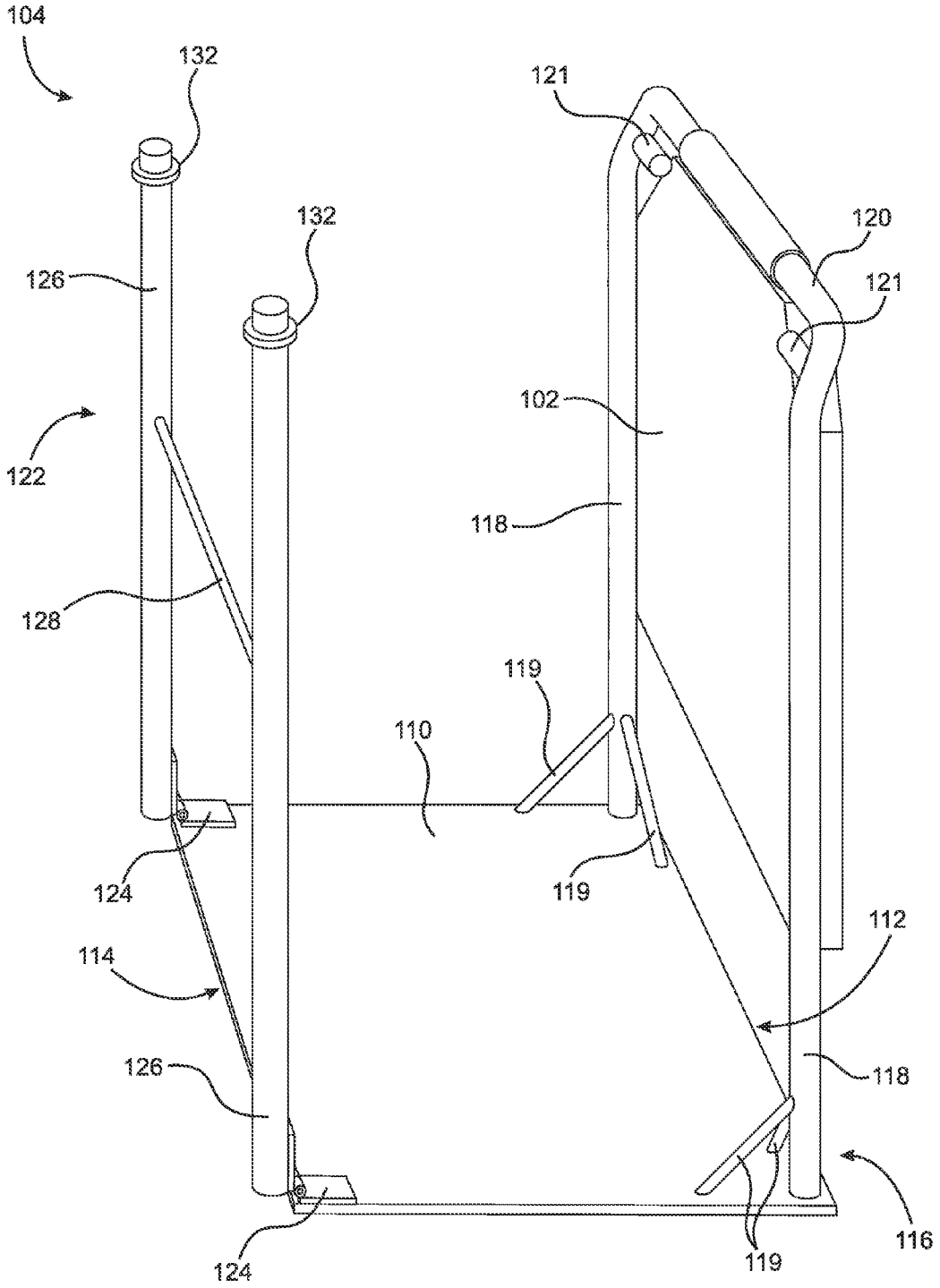
FIG. 3 is a perspective view of a frame of the pack shown in FIG. 1.
Figure 4:
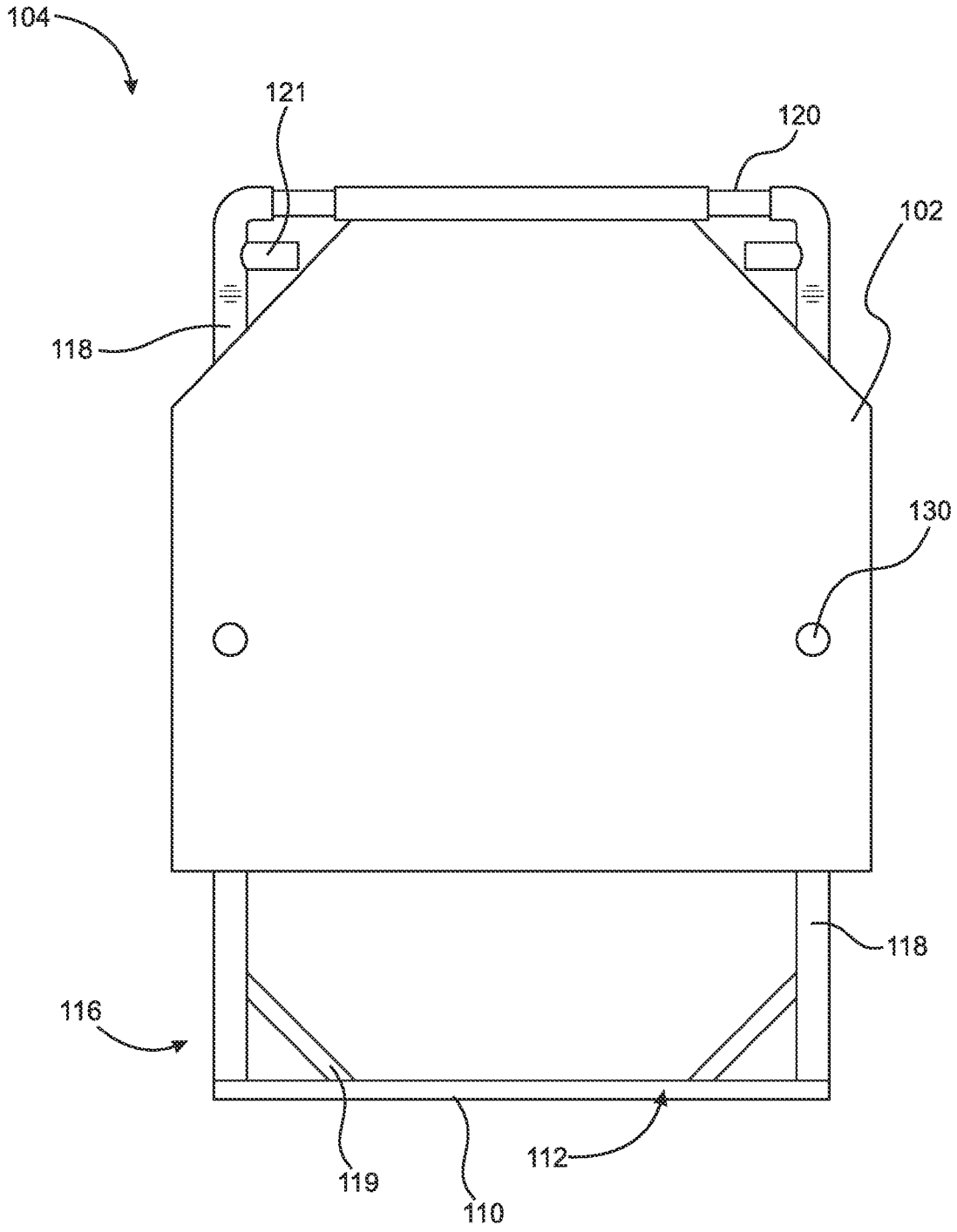
FIG. 4 is a rear view of the frame shown in FIG. 3.
Figure 5:
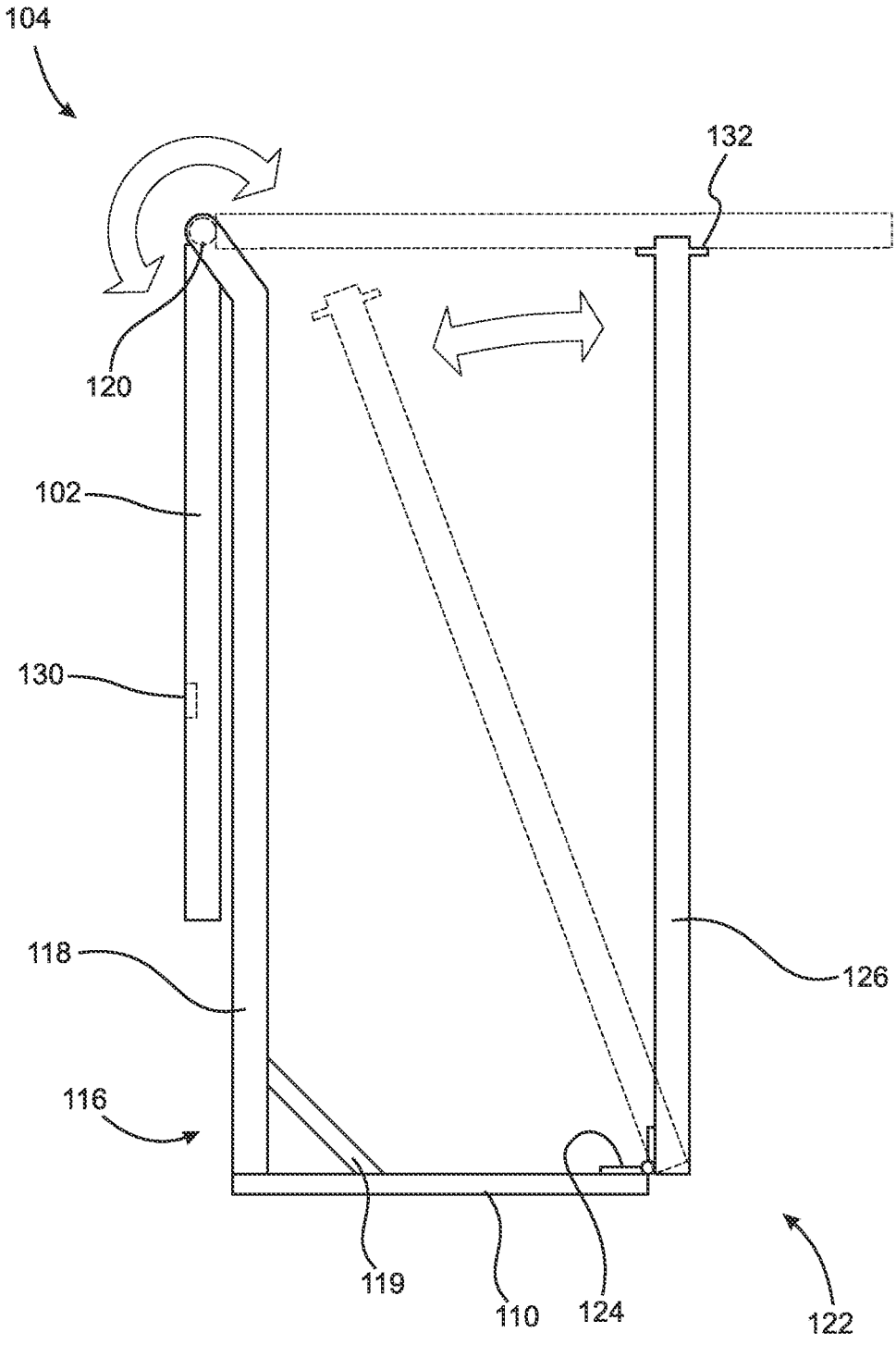
FIG. 5 is a left side view of the frame shown in FIG. 3.

FIG. 2 shows people 301 and 302 seated one behind the other in a row. Such an exemplary seating arrangement is commonly found on buses or planes, or in classrooms, theatres, stadiums, arenas, and many other places. In these places and others, there is often little available space between adjacent seats, so people store items, such as packs, on their laps, in overhead compartments, or on the floor between their feet. However, large, rigid framed backpacks may not be capable of fitting between the seats or in the overhead compartments, limiting placement of those packs solely to the lap of the person. For example, as shown, non-collapsible pack 400 is not capable of fitting between the seats, forcing person 301 to hold her pack on her lap. Due to the collapsibility of pack 100, described in more detail below, person 302 is capable of comfortably placing pack 100 on the floor of the bus.

The following description is best understood in view of FIGS. 3-7. Frame 104 supports seat 102 upon which a user of the pack may sit. Surface 103 of seat 102 is the seating surface, and may be, for example, padded or cushioned to provide a comfortable sitting area. Frame 104 includes base 110, which defines front edge 112 and rear edge 114. Fixed support means 116 is fixedly secured to base 110 proximate to front edge 112, which edges are oppositely disposed on base 110. In the shown embodiment, fixed support means 116 includes two separate leg members 118, although other arrangements are possible. In the shown embodiment, support means 116 includes additional support in the form of reinforcement members 119 affixed between base 110 and each of fixed legs 118 since the fixed legs are secured in a cantilevered manner from base 110. In the shown embodiment, fixed support means 116 includes two reinforcement members 119 affixed between the base and each leg 118. The two reinforcement members affixed to each leg are arranged substantially perpendicular to each other and at approximately a 45 degree angle with respect to the plane of base member 110 to provide improved support.

It should be appreciated that other arrangements and/or forms of support are possible, and that in some embodiments additional reinforcement may not be required. For example, there could be a different number of reinforcement members 119, or the reinforcement members could be beams, rods, plates, brackets, or the like. In one embodiment, the fixed support means could be made from beams having I, L, or T-shaped cross-sections as opposed to cylindrical tubes or rods. These various cross-sections may provide sufficient support when affixed to the base, rendering additional support members unnecessary. Crossbar 120 may be included to fixedly connect the two legs together for providing additional support and reinforcement. Legs 118 may be formed integrally with or separately from crossbar 120. In one embodiment, crossbar 120 is not included, and the seat is connected directly to the fixed legs by a hinge means. Projections 121 may be included to assist in the attachment of shell 106 or straps 108, for example, to frame 104.

Frame 104 also includes hinged support means 122, which includes hinged legs 126 pivotally connected to base 110 by hinge 124 at rear edge 114. In the shown embodiment, hinged legs 126 are arranged such that the legs generally hang over rear edge 114 of base member 110. This overhang permits hinged legs 126 to pivot both towards and away from fixed legs 118. Alternatively, the hinged legs could be tapered, rounded, or chamfered to accommodate the pivoting of the hinged legs in both directions over base 110. In the shown embodiment, support rod 128 is fixedly secured between hinged legs 126 for enabling the hinged legs to pivot in unison.

Figure 6:
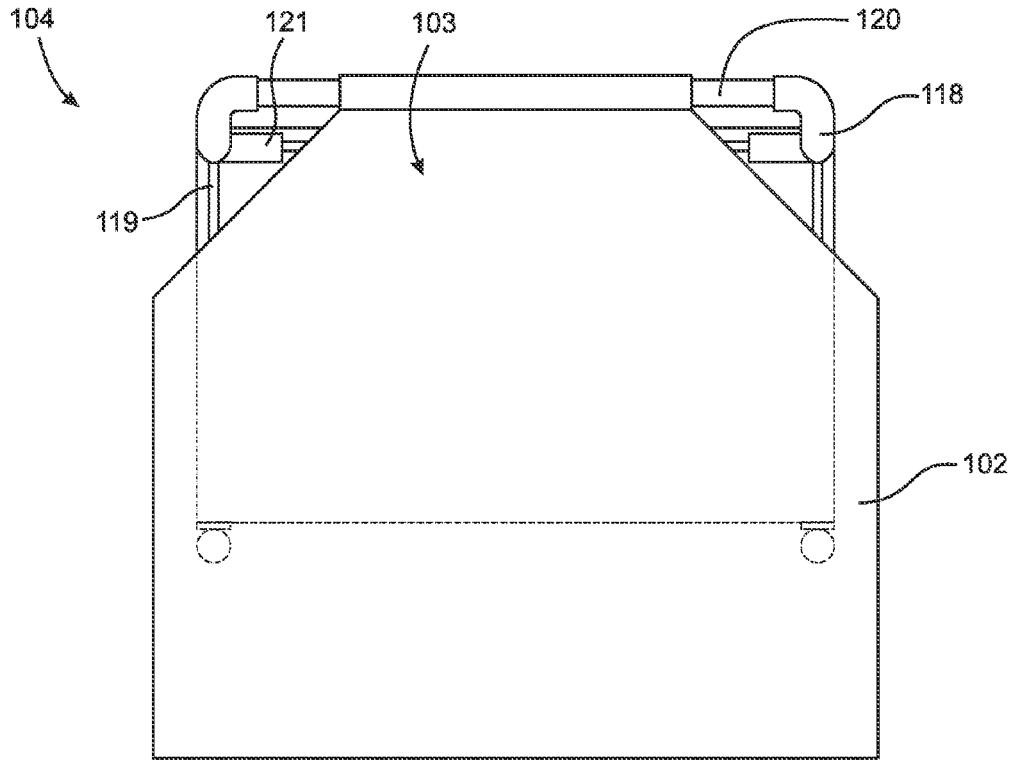
FIG. 6 is a top plan view of the frame shown in FIG. 3 arranged in a seating position.
Figure 7:
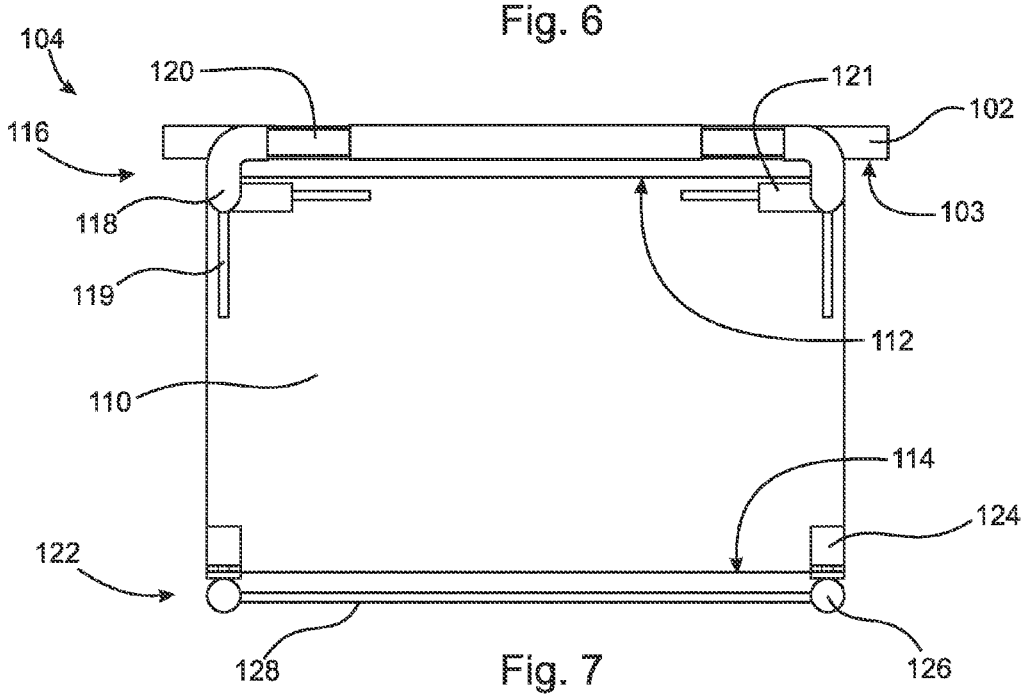
FIG. 7 is a top plan view of the frame shown in FIG. 3 arranged in a storage position.

Seat 102 is hingedly connected to frame 104. In the shown embodiment, seat 102 is hinged about crossbar 120, which is fixedly secured to base 110 through fixed legs 118. When arranged in a sitting position, seat 102 is supported by fixed support means 116, and hinged support means 122, specifically, crossbar 120 and the ends of hinged legs 126. Frame 104 includes two of each type of legs, fixed and hinged, as shown throughout the Figures. However, it should be appreciated that a single leg member, or more than two leg members could be included. To prevent the hinged support means from pivoting out from under seat 102 when a user sits on the seat, bores 130 may be included in the seat that align and engage with the ends of the hinged legs. Stoppers 132 may be included at the end of each hinged leg 126 to support against seat 102, particularly if bores 130 are through the entire thickness of seat 102. In the shown embodiment, seat 102 is larger than base 110 in both width (left to right as shown in FIG. 6) and length (top to bottom as shown in FIG. 6). However, it should be appreciated that one or more dimensions of the seat could be smaller than or the same size as the base.

Figure 8:
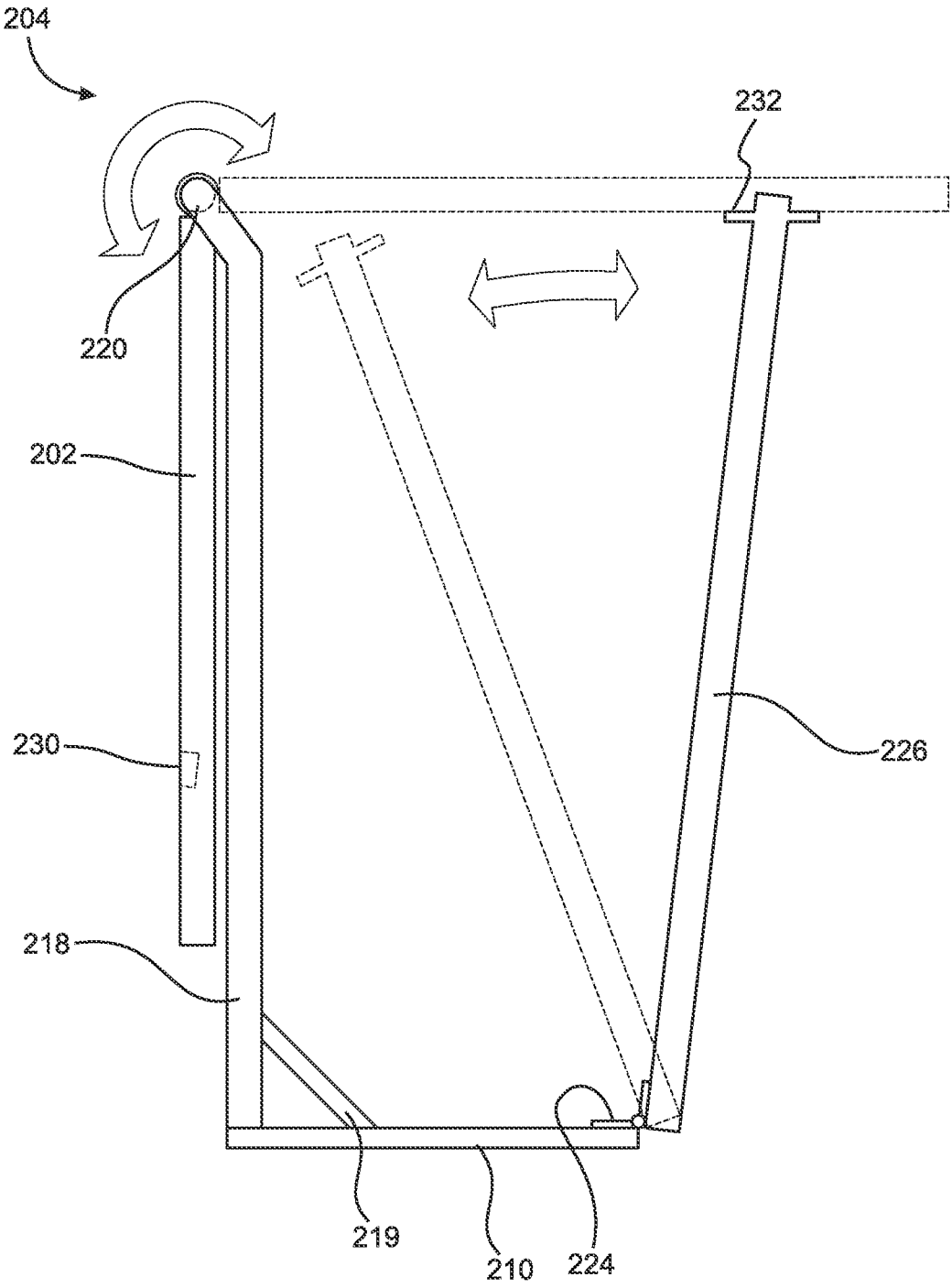
FIG. 8 is a perspective view of a frame according to a second embodiment of the current invention.

Frame 204 is shown in FIG. 8. It should be appreciated that the above description generally describes the functionality of frame 204, as frame 204 generally resembles frame 104. That is, components of frame 204 correspond to similarly numbered components of frame 104, with the last two digits being the same for corresponding components. For example, seat 202 corresponds to seat 102, fixed legs 218 to fixed legs 118, and hinged legs 226 to hinged legs 126. Unlike frame 104, when frame 204 is in the seating position, hinged legs 226 are at an angle greater than 90° with respect to base 210, leaning away from fixed legs 218. Preferably this angle is approximately 120°, as shown in FIG. 8. In this way, the seat can be, for example, enlarged and still properly supported, or a smaller base can be utilized to save space and material. To accommodate the angle at which the hinged legs engage with the seat, bores 230 in seat 202 are at an angle corresponding to the hinged legs. Likewise, stopper 232 is at an angle with respect to the hinged legs, so that the stopper corresponds with the bottom of the seat for supporting the seat. Alternatively, an end portion of the hinged legs could be bent back, putting the ends of the hinged legs into vertical alignment for engagement with the seat.

It should be appreciated that the seat could be hingedly or pivotally secured to the frame by any suitable means known in the art. Similarly, the hinged legs could be connected to the base by any suitable means. For example, in FIG. 3, the hinged rotation of the seat is achieved by engaging a tube about a rod, so that the tube is rotatable about the rod. A similar style of hinge is used in the shown embodiment for butt hinges 124. If two or more hinged legs are included, the hinge could be continuous, that is, extending between and connecting the legs. For example, continuous hinge 224 is shown between the hinged legs in FIG. 9. Alternatively, a separate hinge could be secured between each leg and the base. In one embodiment, a rod is affixed to the seat, and the rod engaged sockets, which are, for example, in the fixed legs or a component affixed to the ends of the fixed legs. Similarly, a pin could run through a hole in one end of the hinged legs and engage rotatably in sockets of a bracket affixed to the base, or the pin be affixed to the end of the hinged legs and engage in sockets of a bracketing means secured to the base.

Figure 9:
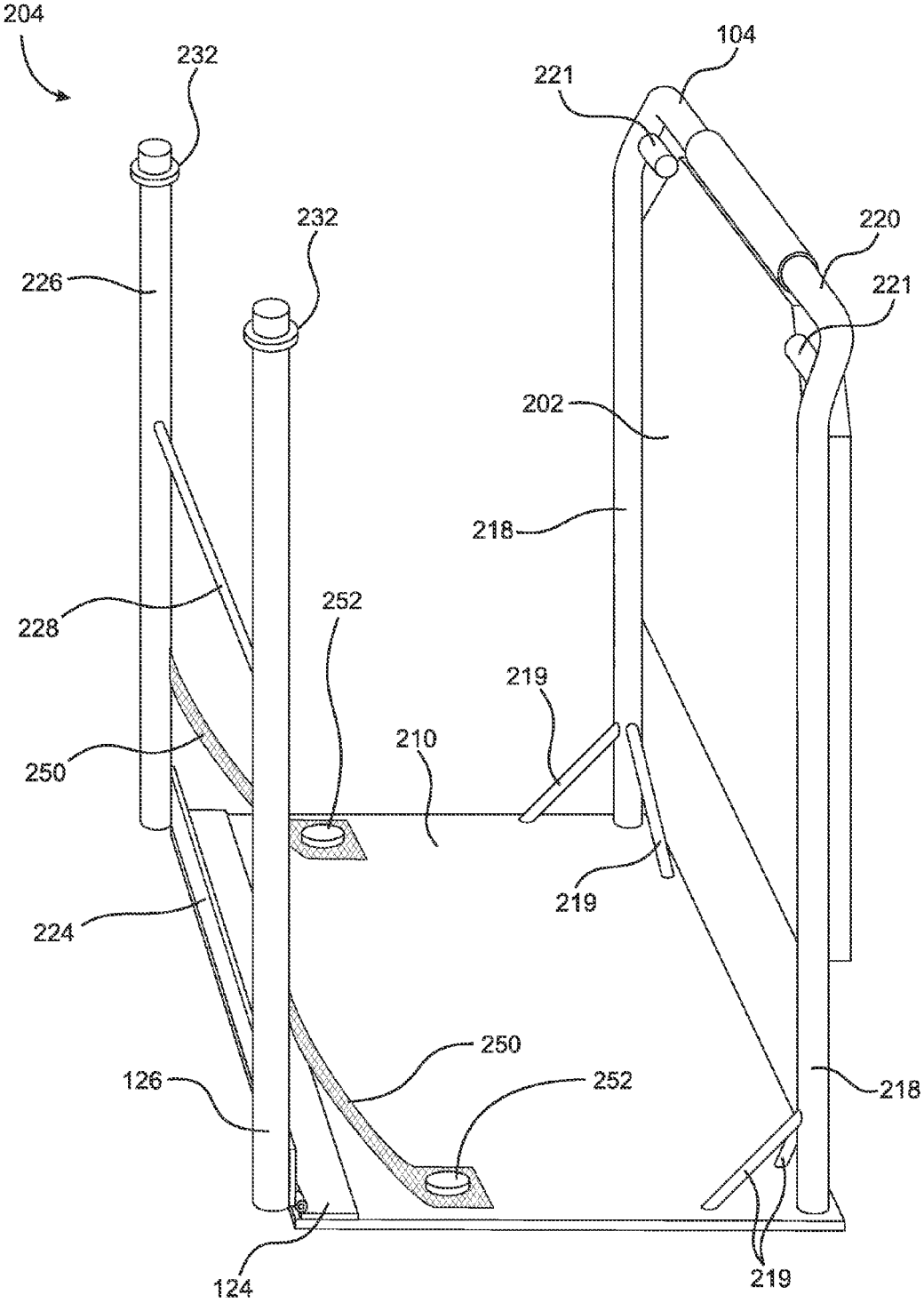
FIG. 9 is a perspective view of a frame having both a continuous hinge connecting first and second hinged legs together, and a strap hinge between each hinged leg and a base member.

As another example, the hinged legs could be secured to the base by a strap hinge, namely, one or more flexible straps affixed between the hinged legs and the base. Such a hinge could similarly be included between the seat and the fixed support means. Strap 250 is shown in FIG. 9 for providing a means of restricting the rotation of the hinged legs 226 to a maximum angle, at which angle the hinged legs engage with seat 202. Strap 250 also could be used to help absorb some of the forces and counteract the corresponding moments which would otherwise be exerted solely on or about the hinges when a user sits on the seat. Such a strap may be particularly advantageous in an embodiment similar to the one shown in FIGS. 8 and 9, since the force exerted by a user sitting on the seat of frame 204 will be translated into horizontal and vertical components, which will subject the legs to bending. Since the strap is flexible, it will not interfere with the hinged legs rotating back toward the front edge of the frame for enabling collapsibility of the frame. It should be appreciated that continuous hinge 224 and strap hinges 250 do not need to be used in conjunction, but that either method could be used individually to provide a satisfactory hinge means. In addition, combinations of any of the above described methods or any other method of providing hinged or pivoted support known in the art, should be considered within the scope of the current invention.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claim is:

1. A pack with an integrated seat, comprising:

a base member comprising oppositely disposed first and second edges;

at least one fixed leg member nonpivotally connected to said first edge;

at least one hinged leg member pivotally connected to said second edge;

a rigid seat member pivotally connected to said at least one fixed leg member and arranged to be supported by said at least one fixed leg member and said at least one hinged leg member when said pack is arranged in a seating position;

a shell arranged to at least partially enclose a volume defined by said at least one fixed leg member, said at least one hinged leg member, and said base member.

2. The pack of claim 1, wherein said base member is a rigid material.

3. The pack of claim 1, wherein said at least one fixed leg member comprises first and second fixed leg members.

4. The pack of claim 3, wherein said first and second fixed leg members are fixedly connected to each other by a cross-bar.

5. The pack of claim 1, wherein said at least one hinged leg member comprises first and second hinged leg members.

6. The pack of claim 5, wherein each of said first and second hinged leg members are pivotally connected to said base member by a butt hinge, a continuous hinge, a strap hinge, or combinations thereof.

7. The pack of claim 6, wherein said first and second hinged leg members are fixedly connected to each other by said continuous hinge.

8. The pack of claim 5, wherein said first and second hinged leg members are fixedly connected to each other.

9. The pack of claim 1, wherein said at least one hinged leg member is arranged to pivot toward said at least one fixed leg member, pivot away from said at least one fixed leg member, or pivot toward and away from said at least one fixed leg member.

10. The pack of claim 1, wherein said rigid seat member has at least one padded surface.

11. The pack of claim 1, wherein said shell comprises a flexible material.

12. The pack of claim 1, wherein at least one shoulder strap for enabling a user to carry said pack is connected to said shell, said at least one fixed leg members, said at least one hinged leg members, said base member, or combinations thereof.

13. The pack of claim 1, wherein said at least one fixed leg member is perpendicularly secured to said base member and said at least one hinged leg member is perpendicularly oriented with respect to said base member when said pack is in said seating position.

14. The pack of claim 1, wherein said at least one hinged leg member is at an angle greater than 90° with respect to said base member and directed away from said first edge when said pack is in said seating position.

15. The pack of claim 1, wherein said seat has a bore operatively arranged for engagement with said at least one hinged leg member when said pack is in said seating position.

16. The pack of claim 1, wherein at least one cargo strap for providing additional storage space is connected to said shell, said at least one fixed leg member, said at least one hinged leg member, said base member or combinations thereof.

17. A pack with an integrated seat, comprising:

a base member with oppositely disposed first and second edges;

first and second fixed leg members nonpivotally connected to said first edge;

first and second hinged leg members pivotally connected to said second edge;

a rigid seat member pivotally connected to said first and second fixed leg members and arranged to be supported by said first and second fixed leg members and said first and second hinged leg members when in a seating position;

a shell comprised of a flexible material, a rigid material, or combinations thereof, and arranged to at least partially enclose a volume defined by said fixed leg members, said hinged leg members, and said base member; and, at least one strap connected to said shell, said fixed leg members, said hinged leg members, said base member, or combinations thereof.

* * * * *